US010126087B1

(12) United States Patent
Grace et al.

(10) Patent No.: US 10,126,087 B1
(45) Date of Patent: Nov. 13, 2018

(54) ARCHERY BOW AXLE ASSEMBLY

(71) Applicant: Grace Engineering Corp., Memphis, MI (US)

(72) Inventors: Nathaniel E. Grace, Fort Gratiot, MI (US); Scott C. Prater, Imlay City, MI (US); Rayomen E. Church, Oakland, MI (US)

(73) Assignee: Grace Engineering Corp., Memphis, MI (US)

( * ) Notice: Subject to any disclaimer, the term of this patent is extended or adjusted under 35 U.S.C. 154(b) by 0 days.

(21) Appl. No.: 15/883,382

(22) Filed: Jan. 30, 2018

(51) Int. Cl.
*F41B 5/10* (2006.01)
*F41B 5/12* (2006.01)

(52) U.S. Cl.
CPC ..... *F41B 5/105* (2013.01); *F41B 5/123* (2013.01)

(58) Field of Classification Search
CPC ..... F41B 5/10; F41B 5/105; F41B 5/123
See application file for complete search history.

(56) References Cited

U.S. PATENT DOCUMENTS

| | | | |
|---|---|---|---|
| 3,055,100 | A | 9/1962 | Kimpel |
| 3,112,547 | A | 12/1963 | Poe |
| 3,548,704 | A | 12/1970 | Kutryk |
| 4,561,413 | A | 12/1985 | Jennings |
| 4,660,536 | A | 4/1987 | McPherson |
| 4,770,154 | A | 9/1988 | Cook et al. |
| 5,020,507 | A | 6/1991 | Larson |
| 5,211,155 | A | 5/1993 | Zamojski |
| 5,381,777 | A | 1/1995 | Mitchell et al. |
| 5,390,655 | A | 2/1995 | Mitchell et al. |
| 5,535,727 | A | 7/1996 | Helmuth |
| 5,672,036 | A | 9/1997 | Medal |
| 5,697,355 | A | 12/1997 | Schaffer |
| 6,415,780 | B1 | 7/2002 | Proctor |
| 6,474,324 | B1 | 11/2002 | Despart et al. |
| 6,537,006 | B1 | 3/2003 | Clark |
| 6,871,643 | B2 | 3/2005 | Cooper et al. |
| 6,964,271 | B2 | 11/2005 | Andrews |
| 6,990,970 | B1 | 1/2006 | Darlington |
| 7,305,979 | B1 | 12/2007 | Yehle |
| 7,441,555 | B1 | 10/2008 | Larson |
| 7,938,109 | B1 | 5/2011 | Larson |
| 7,971,582 | B1 | 7/2011 | Larson |
| 7,980,235 | B1 | 7/2011 | Kronengold et al. |
| 8,069,848 | B1 | 12/2011 | Larson |
| 8,281,773 | B2 | 10/2012 | Dahl, II et al. |

(Continued)

*Primary Examiner* — John Ricci
(74) *Attorney, Agent, or Firm* — Warner Norcross + Judd, LLP

(57) ABSTRACT

An archery bow is provided including an axle assembly that compresses bearing and other components between limb portions to clamp those components against one another, with zero gaps therebetween, yet enable a cam to freely rotate relative to the axle. The bow can include bearings having an inner portion, and an outer portion non-rotatably joined with a cam. A fastener is operable in a compression mode to exert a compression force, such as an axial clamping force, against the bearing inner portion so it is non-rotatable relative to the axle, while the outer portion remains uncompressed and rotatable relative to the axle. The assembly can include a compression spacer clamped under the compression force between inner portions of bearings. These constructions can enhance the consistency of cam rotation and promote a smooth draw of the bow. Related methods are also provided.

20 Claims, 6 Drawing Sheets

(56) References Cited

U.S. PATENT DOCUMENTS

| | | | |
|---|---|---|---|
| 8,281,775 | B1 | 10/2012 | Larson |
| 8,408,193 | B2 | 4/2013 | McPherson |
| 8,528,534 | B2 | 9/2013 | McPherson |
| 8,991,376 | B2 | 3/2015 | McPherson |
| 9,115,953 | B1 | 8/2015 | Huang |
| 9,453,698 | B1 | 9/2016 | Grace |
| 9,528,788 | B2 | 12/2016 | McPherson |
| 2011/0070049 | A1 | 3/2011 | Wang |

ARCHERY BOW AXLE ASSEMBLY

BACKGROUND OF THE INVENTION

The present invention relates to archery products, and more particularly to an axle assembly for a cam on an archery bow.

Conventional compound and crossbow archery bows include a bowstring and a set of power cables that transfer energy from the limbs and cams, eccentrics or pulleys (which are all referred to generally as "cams" herein) of the bow to the bowstring, and thus to an arrow shot from the bow. The function of the cams is to provide a mechanical advantage so that energy imparted to the arrow is a multiple of that required of an archer to draw the bow. The cams typically are rotatably mounted to limbs via respective axles.

Generally, there are two primary types of limb systems for archery bows. Some bows include solid limbs that define recesses configured to receive cams near the free ends of the solid limbs. The remainder of the solid limbs, from the recess to the riser, is solid and one piece. Other bows include split limbs, which include two parallel, smaller limbs that are generally separate from one another along their length from the cam to the riser. Each type of limb system offers certain advantages over the other, while each also has its drawbacks.

One drawback of split limb systems, (and even some solid limb systems) is that most have a floating axle system that takes up some, but not all of the slop and spacing between different components mounted between the ends of the axle. Typically, a floating axle system includes a predetermined overall stack up width (the width of cam components "stacked" adjacent one another on the axle) defined by the two e-clips registered in corresponding grooves on the axle. These systems typically include multiple flat spacers or washers of random thickness to establish the predetermined overall stack up width. The spacers are helpful in that they can locate the cam components in a general lateral position relative to one another, however, with this floating axle system, it is virtually impossible to eliminate all the gaps between cam components on the axle without compressing and binding bearings disposed along the axle that assist in rotation of the cams. Thus, virtually all of these floating axle systems have gaps between the components on the axle. Accordingly, the cams and components can slide laterally along the axle, which can lead to inconsistent and/or imprecise rotation of the cams.

Some manufacturers have attempted to replace floating axle systems with threaded axle systems that delete the e-clips. In a threaded axle system, an axle is provided with a threaded opening at one or both ends, and a corresponding fastener is threaded into the opening in an attempt to eliminate excess space between components along the axle, such as bearing, cams and bushings. While some claim that this threaded axle system provides zero tolerance and zero space between the components, it is believed that in reality, there is some space between the elements, especially when the components wear at the points of contact over time. This can lead to larger unwanted gaps and lateral movement along the axle, which again generates inconsistent and sometimes slightly misaligned rotation of the components on the axle. Further, these systems are designed so that the tightening of the fastener does not compress the components along the axle (the components are merely very close to one another), which compression can crush the bearings such that the cam will not rotate well in this system. In most cases, these systems are designed so the fastener bottoms out before putting any compression on the components along the axle, which again results in those systems failing to eliminate all the slack and gaps in the stack up of components along the axle.

Accordingly, there remains room for improvement in the field of archery bows, and in particular, axle systems for rotating cams.

SUMMARY OF THE INVENTION

An archery bow is provided including an axle assembly that compresses bearing and other components between limb portions to clamp those components against one another, with zero gaps therebetween, yet enable a cam to freely rotate relative to the axle.

In one embodiment, the bow can include an axle assembly including a bearing having an inner portion and an outer portion which is non-rotatably joined with a cam. The axle assembly and/or a fastener of the assembly is operable in a compression mode to exert a compression force, such as an axial clamping force, against the bearing inner portion so the bearing inner portion is non-rotatable relative to the axle, while the outer portion remains uncompressed and rotatable relative to the axle, along with the cam.

In another embodiment, the bow can include a compression spacer clamped under the compression force between inner portions of two or more bearings mounted along the axle.

In even another embodiment, the compression spacer can be disposed within a cam bore defined by a cam rotatably mounted on the axle. The compression spacer can be clamped between the inner portions of spaced apart bearings. The compression spacer and inner portions of the bearings can be non-rotatable relative to one another and relative to the axle and limb due to the compression force. The cam however can be joined with the outer portions of the bearings, and these elements can rotate together about the inner portions of the bearings and generally around the compression spacer.

In still another embodiment, the compression spacer can include first and second rims that respectively engage and are clamped against first and second inner portions of respective first and second bearings. Inset from the rims can be first and second flanges that extend radially away from a longitudinal axis of the axle, and generally toward an interior wall of the cam bore. Optionally, the cam bore can be of a single, uniform diameter from one side of the cam to the opposing side, except for small portions adjacent the cam sides to accommodate a lip of the bearings.

In yet another embodiment, the axle assembly can include first and second cam spacers disposed outward from, but adjacent, respective first and second bearings. The cam spacers can be stepped with first and second spacer rims disposed on an interior side and an exterior side of a cam spacer flange. The first and second cam spacer rims can be compressed under the compression force against the adjacent bearing and optionally a limb portion, while the cam spacer flange extends radially outward, adjacent the outer portions of the bearings, without contacting the outer portions of the bearings and generally concealing or protecting those bearings from the environment.

In still yet another embodiment, the axle assembly can include an axle cap having a ring disposed between a head of a fastener and the axle. The axle can include a shoulder. The ring can bottom out against the shoulder when a compression force, for example, an axial clamp force, is achieved by tightening the fastener relative to the axle.

In a further embodiment, the compression force is an axial clamp force optionally of at least 1 pound, further optionally between 1 pound and 500 pounds.

In yet a further embodiment, a method of assembling an archery bow is provided. The method can include providing a bow with the above components, for example, providing a bearing comprising an inner portion and an outer portion, which is non-rotatably joined with a cam having a bowstring track; placing the bearing between portions of a limb; installing an axle through the bearing inner portion; and clamping with a compression force, such as an axial clamping force, greater than 1 pound the bearing inner portion between the limb portions. The outer portion is uncompressed when the axial clamping force is applied to the inner portion so that the outer portion and the cam are rotatable relative to the axle, while the inner portion is non-rotatable relative to the axle under the axial clamping force.

The archery bow of the current embodiments can provide an axle assembly that compresses bearing components between limb portions to clamp those components against one another, with zero gaps therebetween, yet enable other components to freely rotate relative to the axle. For example, the axle assembly can tightly compress all the components thereon, while isolating the outer portions of the bearing to eliminate the dragging, rubbing and or grinding against those outer bearing portions to increase rotational efficiency of the cam and feel to an archer. In this way, the current embodiments can enhance the consistency of cam rotation and promote a smooth draw of the bow. These embodiments also can resolve the tradeoff between having components precisely located along the axle, and having the bearings rotate freely. Each of these characteristics can be achieved every time a bow is built, regardless of the tolerance stack up, the assembler or manufacturer, or the customer who worked on the bow. Noise from the cam rotating also can be diminished. Further, where the bow is a split limb bow and the current embodiments are utilized, that bow can exhibit torsional rigidity comparable to a solid limb bow.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
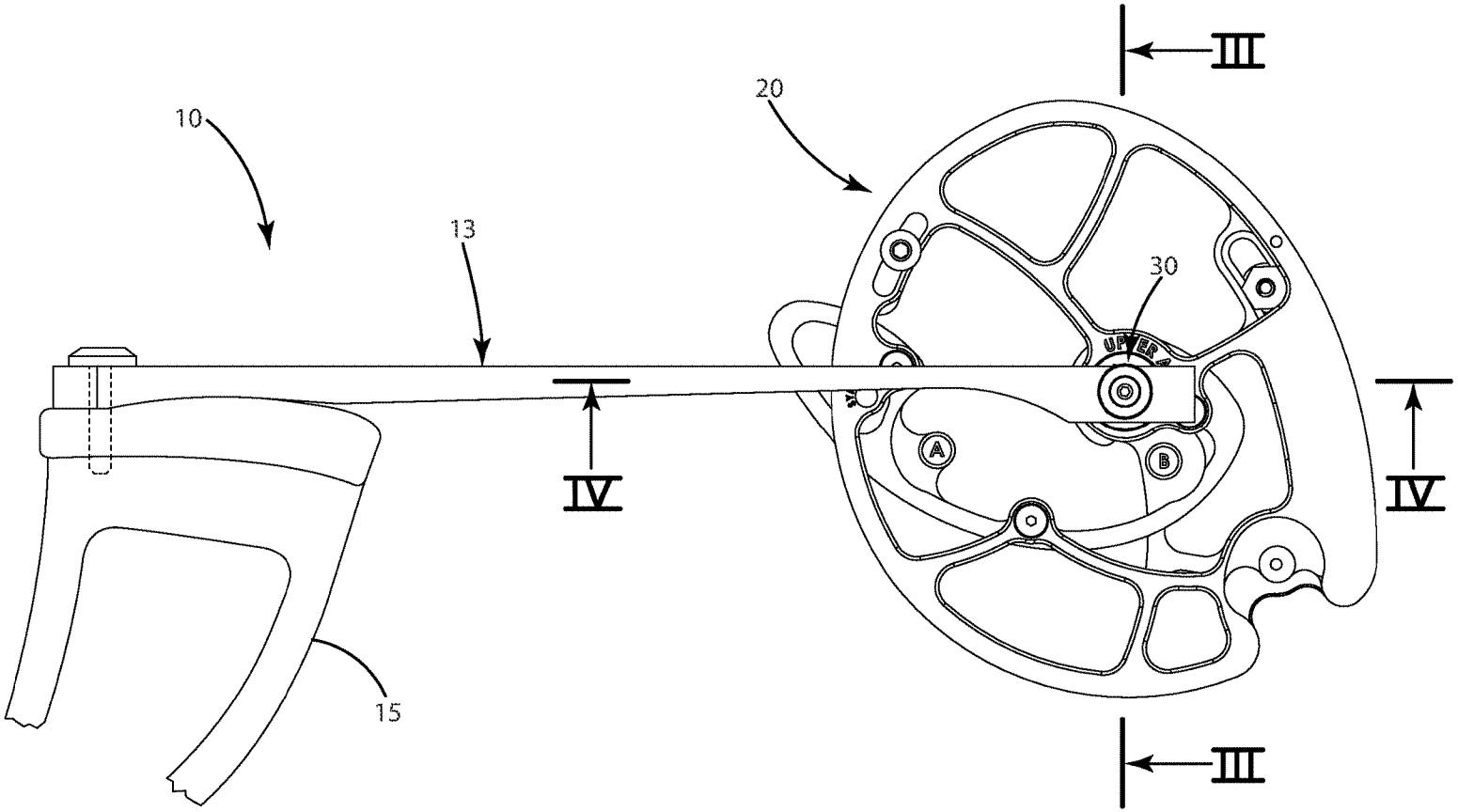
FIG. 1 is a side view of an archery bow including an axle assembly of a current embodiment.

A compound archery bow including one or more cams and an axle system in accordance with a current embodiment is illustrated in FIGS. 1-4 and generally designated 10. The bow can include a cam 20, which optionally is part of a dual cam system on the bow 10. The cam can include a one or more tracks 26, 27, 28, which can be bowstring tracks, a power cable track or other tracks suitable to receive and guide elongated elements such bowstrings and power cables. An example of such a cam is disclosed in U.S. Pat. No. 9,453,698 to Grace, which is hereby incorporated by reference in its entirety.

The cam 20 can be mounted to a limb 13, which can be joined with the riser 15 of the bow. The exemplary cam 20 illustrated can be an upper cam, and the bow can include another lower cam (not shown) spaced apart from the upper cam and of a similar configuration. The limb 13 can be in the form of a split limb, including first sub limb or limb portion 11 and a second sub limb or limb portion 12 that are separated from one another along respective lengths of each of the first sub limb and the second sub limb. Although shown in connection with a split limb, the current embodiments are well suited for solid limbs having limb portions separated somewhere along their length to accommodate a rotating body, as well as limbs having axle systems mounted to pillow blocks that are further mounted to the limbs. Where an axle assembly or its components are described herein as being joined with a limb and/or limb portion, that limb and/or limb portion can be any portion of any type of limb, pillow blocks and/or other mounting structures associated with the limb and/or limb portion.

The cam 20 can be rotatably mounted to the limb 13 via the axle assembly 30. The axle assembly can include a first bearing 50 comprising a first inner portion 51 and a first outer portion 52. The first outer portion 52 can be non-rotatably engaged with the cam 20. The first inner portion 51 can be mounted immediately adjacent the axle 40, and optionally non-rotatable relative to the axle 40. The axle assembly 30 can include one or more fasteners 40A and 40B joined with the axle and operable in a compression mode to thereby compress under a compression force the first inner portion of the first bearing between a first end 41 and the second end 42 of the axle. The first outer portion 52 remains uncompressed when the compression force is applied to the first inner portion 51. As a result, the first outer portion 52 and the cam 20 are rotatable relative to the axle 40, while the first inner portion 51 is non-rotatable relative to the axle 40 under the compression force.

The various other components aligned along the axle, immediately adjacent the axle (other than the cam and the outer portion of any bearings) can be clamped under the compression force, which can be an axial clamping force, between the ends of the axle 40, so they will not rotate upon rotation of the cam under normal circumstances. In this clamped configuration, the components along the axle have zero gaps or tolerances between them individually and the limbs. Indeed, these components are clampingly forced against one another under a compression force, for example, an axial clamping force of optionally at least 1 pound, further optionally at least 5 pounds, yet further optionally at least 10 pounds, even further optionally at least 20 pounds, still further optionally at least 30 pounds, yet further optionally at least 40 pounds, further optionally at least 50 pounds, yet further optionally at least 100 pounds, still further optionally at least 250 pounds, still even further optionally at least 500 pounds, still further optionally between 1 pound and 500 pounds.

Although the current embodiment is described in connection with a dual cam bow, and in particular a binary cam system, the current embodiment and its features are suited for use with simpler pulley systems, for example, in single cam systems. The axle assembly, limb, cam and other features also can be used in other dual cam, cam and a half, and single cam systems as well. Further, the embodiments herein are well suited for compound archery bows, dual cam bows, cam and a half bows, crossbows and other archery systems including two or more cams. As used herein, a "cam" refers to a cam, a pulley, and/or an eccentric, whether a modular, removable part, or an integral part of a cam assembly, for use with an archery bow. However, when a cam is described as an "eccentric cam," this refers to a cam that rotates about an axis distal from a center of the body, for example a geometric center, and this term excludes perfectly circular pulleys such as those used in single cam archery bows.

As used herein, a "track" refers to a structural element that is adapted to guide or accommodate a portion of a bowstring or power cable within or adjacent the element, and can be in the form of a groove, a recess, a slot, pins or posts extending from or defined by a surface or element. When in the form of a groove or recess, that element can be defined by a part of a cam assembly, for example, defined by a bowstring cam and or a power cable cam, and can be of virtually any geometric cross section, for example, partially or fully semi-circular, rounded, triangular, rectangular, square, polygonal, or combinations of the foregoing. The cam and/or module can be formed from rigid material, such as a metal, optionally aluminum, titanium, or magnesium, or a non-metal, optionally composites and/or polymers.

As used herein, an "axis of rotation" refers to an axis about which a cam can and/or does rotate, for example, a rotational axis of cam 20. Optionally, the axis of rotation can coincide with the longitudinal axis LA of axle 40 to which the cam is mounted. Although not described in detail, the cam herein can include modular elements that provide some level of adjustment of a performance characteristic of a bow, including but not limited to, a particular draw length, draw stop or draw force for the bow. The assemblies also can include draw stops and other components common to cams as desired.

Turning now to the current embodiment of the archery bow 10, the cam 20 can include individual cams bowstring cams 26 and 27 that are joined together with one another, and optionally other elements such as a power cable cam 28, via fasteners such as screws, rivets, welds, and other fastening structures. Alternatively, the cam parts can be in the form of a monolithic, continuous single piece structure that includes the cam parts and the respective features thereof. The cam 20 and its components can be constructed from a rigid metal, polymeric, and/or composite structure, and can have a generally volute peripheral shape. Optionally, the cam can be machined from metal, such as aluminum, magnesium or titanium, metal injection molded, and/or formed from a composite material with suitable properties.

The cam 20 is mentioned above is rotatably mounted on the limb 14 which as shown includes a first sub-limb 11 and a second sub limb 12. The cam is mounted between these sub limb parts via an axle assembly 30 including an axle 40 that can project at least partially through a first aperture 11 a defined by the first sub limb (or optionally a first portion of a solid limb or a pillow block) and through a second aperture 12 a defined by the second sub limb (or optionally a second portion of a solid limb or a pillow block). The cam 20 can be adapted to rotate about its axis of rotation, which coincides with the longitudinal axis LA of the axle 40. The axle 40 is configured so that the cam 20 rotates generally about the axle, as explained further below.

The limb 13, that is, each of the sub limbs or other portions of a solid limb, or pillow blocks can include an interior surface. For example the first limb portion 11 can include an interior surface 11I and an exterior surface 11E adjacent the aperture 11A. The other limb portion 12 can include an interior surface 12I and an exterior surface 12E. The interior surfaces of the limb portion can face toward the cam 20, while the exterior surfaces can face away from the cam 20. The interior surfaces, as described in further detail below also can contact and clamped against under a compression force, one or more components that are disposed along the axle assembly between the limbs.

The axle assembly 30 as mentioned above can include first and second fasteners 40A and 40B that are joined with the axle 40 at respective first end 41 and second end 42. Although shown as including two fasteners, a single fastener can be used with the axle and axle assembly, with the opposing end distal from the fastener having a rigid fixed flange or the like that engages the exterior 11E of the limb. Further optionally, the axle 40 itself can be in the form of a large bolt or fastener (not shown) with a head disposed on the exterior surface 11E of one limb portion, and a nut (not shown) attached to threads that protrude from the exterior surface 12E of the other limb portion.

Figure 2:
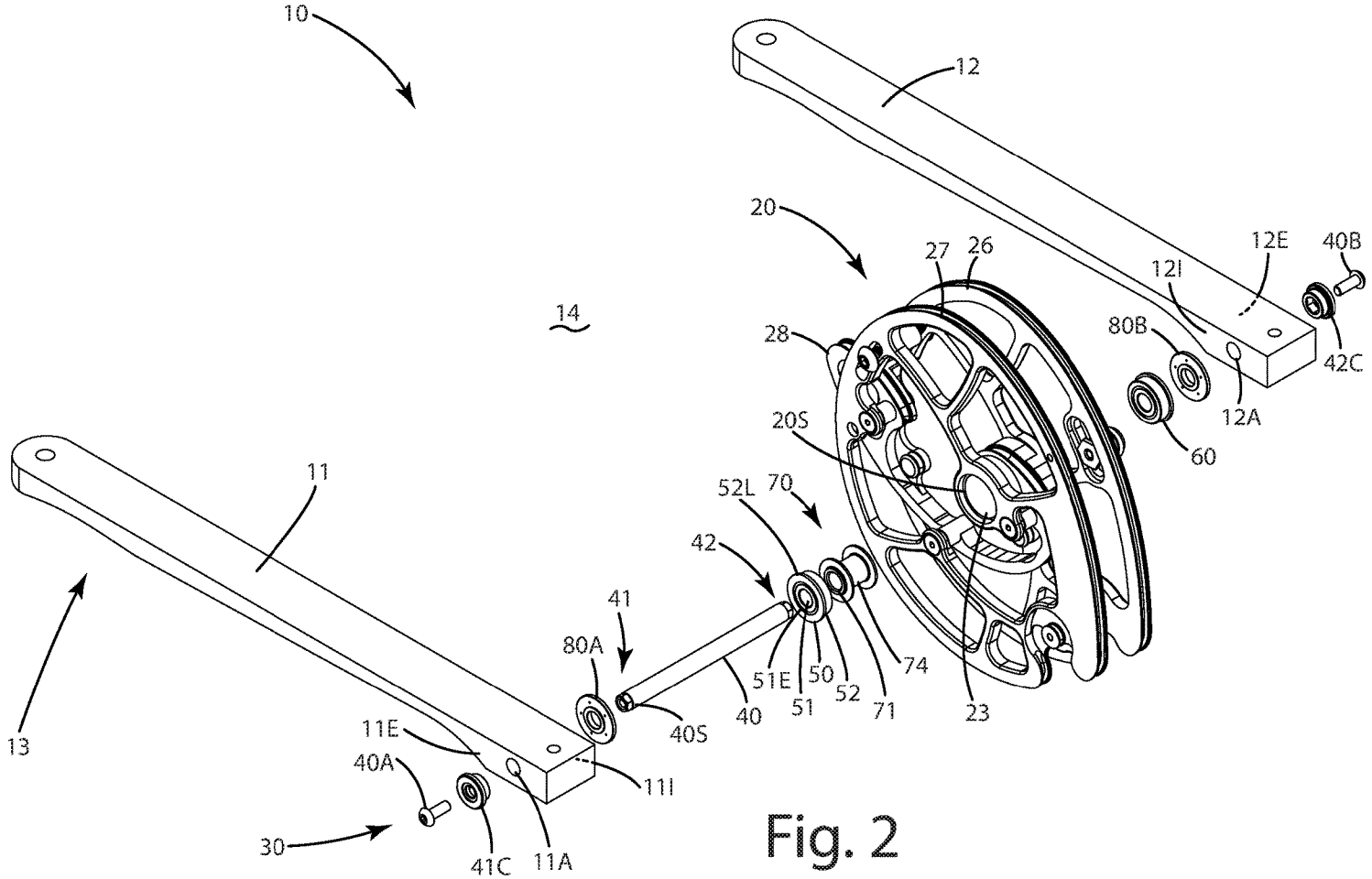
FIG. 2 is an exploded view of the limb, cam and axle assembly.
Figure 3:
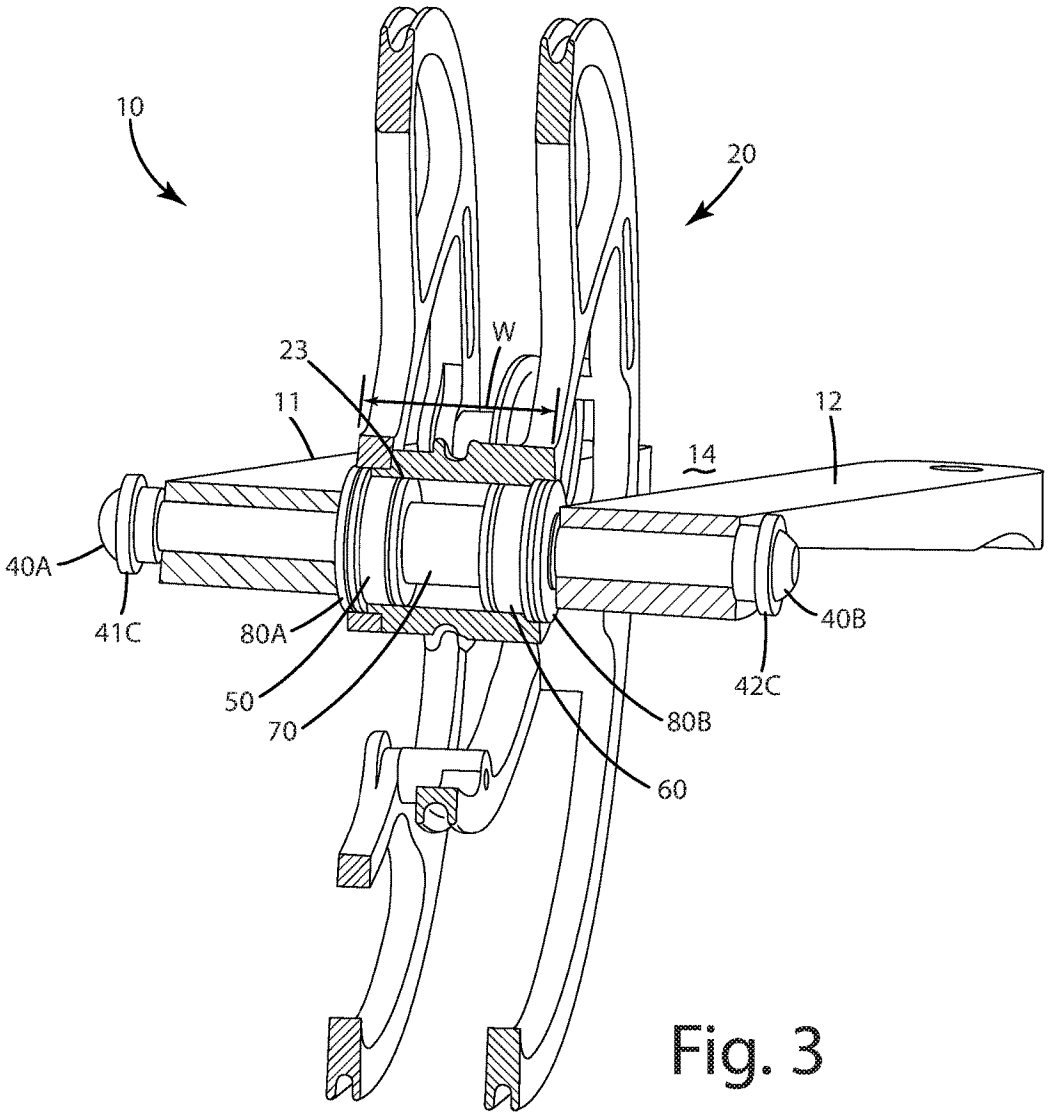
FIG. 3 is a partial section view of the limb, cam and axle assembly taken along lines III-III of FIG. 1.
Figure 4:
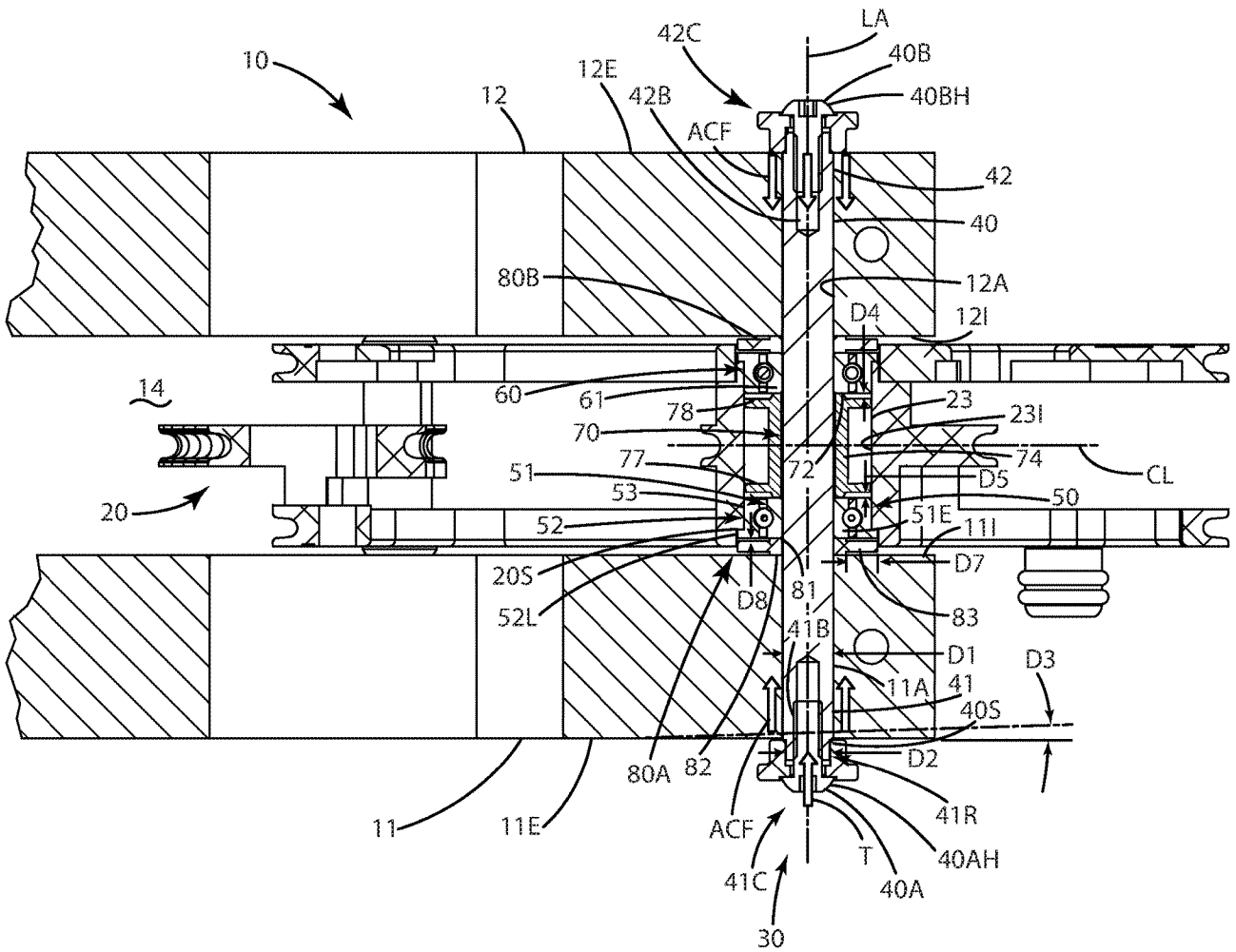
FIG. 4 is a section view of the limb, cam and axle assembly taken along lines IV-IV of FIG. 1.

The axle in FIGS. 2-4 includes a first threaded bore 41B and a second threaded bore 42B at the respective ends. The fastener 40A can be threaded into the bore 41B. The fastener 40B can be threaded into the bore 42B. Although shown as engaging axle caps 41C and 42C, these fasteners optionally can include heads that directly engage the exterior surfaces 11E and/or 12E of the respective limb portions 11 and 12. When tightened, these fasteners 40A and 40B exert an axial clamping force ACF in the direction of the arrows shown in FIG. 4. This axial clamping force ACF basically a compression force against all components that are disposed between, the fasteners 40A and 40B, or generally all components that are disposed between the first end 41 and the second end 42 of the axle 40. These respective components, can be in direct engagement with one another. To the extent that other components, such as the outer portions of bearings 52, 62 and the cam 20 are not engaged by other components under the axial compression force ACF, those components can be free to rotate about the axle 40, as described in further detail below.

The axle assembly 30 can include axle caps 41C and 42C adjacent the respective fasteners 40A and 40B. These caps, for example, can be disposed between a head 40AH of the fastener 40A and the exterior surface 11E of limb. Generally, the axle cap can be disposed between the head 40AH of the fastener 40A, and the remainder of the axle 40. The axle 40 optionally can be configured to include a shoulder 40S that transitions from a larger diameter D1 of the axle to a smaller diameter D2 of the axle. The shoulder can form a ledge annually around the axle 40. The cap 41C can include a an inner ring 41R. This inner ring 41R can engage the shoulder 40S as well as the exterior surface 11E of the limb portion 11. A similar axle cap 42C can interact with another axle shoulder on the other end of the axle. The axle assembly and/or the fastener 40A can operate in a compression mode such that when a fastener is tightened in direction T, into the bore 41B the fastener pushes the axle cap 41C such that the ring 41R engages the exterior surface 11E of the limb 11. Due to its connection to the other fastener 40B, the corresponding fastener 42C likewise engages the exterior surface 12E of the other limb portion 12. In turn, the axle cap rings exert a compression force, for example, the axial clamping forces ACF against the exterior surfaces 11E and 12E of the respective limb portions. This pushes those limb portions inward toward all the other components of the axle assembly between the respective interior surfaces 11I and 12I of the respective limb portions. Thus, as explained further below, that axial clamping force ACF is transferred to and clamps the various components along the axle against one another. Under this axial clamping force, it can be very difficult if not impossible for these clamped components to rotate relative to one another after installation. Of course, the cam 20 and the outer portions 52, 62 of any bearings along the axle system are free to rotate. Due to the axle assembly herein, the outer portion of the bearings and the cam are free to rotate about the axle and relative to any inner portions of the bearings and other components along the axle assembly 30.

Optionally, as mentioned above, the axle 40 can include the shoulder 40S. In some cases, it can be suitable to ensure that the applied axial clamping force ACF does not exceed a threshold value that might bend, dent, mar, damage and/or otherwise impede the function of the limb and the other components along the of the axle assembly 30. Accordingly, the shoulder 40S can be located along the axle 40 such that the ring 40R engages the shoulder 40S when a preselected axial clamp force ACF is achieved by tightening the fastener in direction T relative to the axle. This preselected axial clamp force can optionally at least 1 pound, further optionally at least 5 pounds, yet further optionally at least 10 pounds, even further optionally at least 20 pounds, still further optionally at least 30 pounds, yet further optionally at least 40 pounds, further optionally at least 50 pounds, yet further optionally at least 100 pounds, still further optionally at least 250 pounds, still even further optionally at least 500 pounds, still further optionally between 1 pound and 500 pounds.

Optionally the axial clamp force ACF can be significant enough that the components along the axle do not only contact or engage one another, but instead, the components along the axle forcibly engage against one another so that rotation of those components clamped against one another is impaired and/or prevented. For example, to rotate one component relative to the next adjacent component, against which it is clampingly and forcibly compressed, one of the components will have exerted upon it a torque of optionally at least 1 inch pound, further optionally at least 5 inch pounds, yet further optionally at least 10 inch pounds, yet further optionally at least 15 inch pounds, still further optionally at least 20 inch pounds, or optionally between 1 inch pound and 100 inch pounds. In some cases, the axial clamping force ACF can not only set the gap or tolerance between components along the axle that are abutted against one another to 0.00 inches, but in addition, the axial clamping force ACF press can those components against one another forcefully enough under a compression or clamping force that the components do not rotate relative to one another along the axle without exertion of significant torque.

In some cases, the fastener 40A can be tightened to push the axle cap 41C into the exterior surface 11E (or in some cases a small recess defined by the limb 11 adjacent the exterior surface) such that the axial clamping force ACF actually deflects the limb 11 toward the other limb 12 by a deflection distance D3. Due to the corresponding axial compression force ACF on the other limb portion 12, that limb portion 12 also can be deflected that same or a similar deflection distance D3 toward the other limb portion 11. Optionally, this deflection distance D3 can be preselected so that it does not impair or deteriorate the function of the limb portions 11 and 12 and/or the cam rotation of the cam 20. Further optionally, the preselected deflection distance can be optionally at least 0.001 inches, further optionally 0.001 inches to 0.100 inches or other amounts depending on the application.

As shown in FIG. 4, when the axle assembly 30 is assembled, the various components disposed between the limbs, are under a compression force, for example the axial clamping force ACF described above. Under the axial clamping force ACF, the various components are pressed together and engage one another so that there optionally is zero gap or tolerance between each of the components. Further, these components, effectively can be clamped against one another and forcefully engage one another under that axial clamping force.

The axle assembly 30 can include one or more bearings. As illustrated in FIGS. 1-4, the axle assembly includes a first bearing 50 and a second bearing 60. Only the first bearing will be described because the second bearing is identical to it. The first bearing 50 can be in the form of a ball bearing, but of course can be in the form of a pin bearing, a roller bearing, a bushing, or the like. As shown, the first bearing 50 includes an inner portion 51 and an outer portion 52. The inner portion 51 can be an inner raceway that is disposed immediately adjacent the axle when the bearing is on the axle. The outer portion 52 can be an outer raceway. Between the inner portion and the outer portion, ball bearings, pins, rollers or, the like can be disposed so that the outer portion 52 rotates freely relative to the inner portion 51. The outer portion 52 can include a lip 52L that seats against a first cam seat 20S when the first bearing 50 is disposed at least partially within a cam bore 23. This cam bore 23 can be defined through a substantial portion of the cam 20. For example, the cam bore can extend across the width W of the cam 20. The cam bore diameter can be substantially the same or greater than the diameter of the bearing outer portion 52 (excluding a lip 52L of the bearing), across a majority if not all the width W of the cam bore 23. The cam bore 23 can be of a cylindrical shape and configured to accommodate the various components of the axle assembly therewithin, while further optionally concealing and shielding the bearings from the elements via the closure or capping of that bore with other components as explained in detail below.

With reference to FIG. 4, the first and second bearings 50 and 60 can be installed relative to the cam on opposite sides of the cam, in opposite sides of the cam bore. Both of the bearings can be included in position within at least a portion of the bore 23. As shown, the outer or exterior surface or wall 53 of the outer portion 52 can directly engage the interior wall 231 of the bore 23. This outer portion can be pressed or friction fit into the cam or otherwise secured to the interior wall 231 of the bore 23. In this manner, the outer portion 52 of the bearing 50 can be non-rotatably engaged with the cam. The second bearing 60 can include similar inner and outer portions and can likewise be fitted in the cam bore or otherwise attached the cam in a similar manner as the first bearing 50.

The optional lip 52L can engage the shoulder 20S of the cam bore 23 to effectively set the depth at which the first bearing 50 is inserted into the cam bore 23. In some cases, the shoulder 20S can be deleted from the cam bore, with the lip 52L simply resting on an exterior surface of the cam 20. As noted above, the cam bore 23 can be of a slightly smaller diameter than the diameter of the outer portion at the exterior surface 53. The cam bore can be this diameter, which is greater than the diameter of the axle and the inner portions of the bearings, across the entire width W of the cam 20.

The axle assembly shown in FIG. 4 also can include a compression spacer 70 located adjacent the axle, between the first bearing 50 and the second bearing 60. The compression spacer can effectively enable the axial clamping force ACF to be transmitted through the inner portions of the two bearings, without facilitating transfer of that force to the outer portions of the first and second bearings. The compression spacer can include an elongate body 74 that terminates at a first rim 71 and a second rim 72 distal from the first rim along the axle or along the body 74. These rims can include outermost edges that directly engage the respective first inner portion 51 and second inner portion 61 of the first and second bearings. This engagement can be under a compression force, for example the axial clamping force ACF. The elongate body 74 shown is substantially cylindrical, but can be any other tube shape. The compression spacer can circumferentiate the axle 40. The compression spacer can be removably mounted in the cam bore 23, and can extend from adjacent the fire bearing, across the center line CL of the cam body, to the second bearing. This removable compression spacer can span a majority of the cam bore's length and/or the width W of the cam 20.

Optionally, the compression spacer 70 can include a first flange 77 and a second flange 78 distal from one another along the elongate body. These flanges optionally can be annular and can extend radially outward from the longitudinal axis LA of the axle, which also corresponds to a longitudinal axis of the compression spacer. Both the first and second flanges can be inset a distance from the adjacent first and second rims. For example, the first annular flange 77 can be inset a first distance D4 from the first rim 71, while the second flange 78 can be inset a second distance D5 from the second rim 72. These first and second distances can be equal. These distances can be optionally at least 0.001 inches, further optionally at least 0.010 inches, yet further optionally at least 0.100 inches or other distances depending on the application. These first and second distances also can be can correspond to or be equal to a distance away from which the first and second flanges are offset from the respective first outer portion of the first bearing 50 and second outer portion of the second bearing 60. With these offset distances D4 and D5, the annular flanges do not engage the outer portions of the bearings. Further optionally, no portion of the compression spacer engages the outer portions of the respective bearings.

In some cases, the flanges 77 and 78 can be sized to correspond closely to a diameter of the cam bore 23. In this manner, the compression spacer can be precisely fitted within the cam bore 23 so that it generally centers within the cam bore. This can facilitate insertion of the axle 40 through the bearings and/or compression spacer. Optionally, the flanges can support the elongate body 74 so that its longitudinal axis centers on the longitudinal axis LA of the axle. Further optionally, the compression spacer 70 can be slightly compressed or friction fit within the cam bore in some applications. In yet other cases, the flanges 77, 78 can be deleted and the compression spacer can be a simple cylindrical sleeve or tube. In still other cases, the compression spacer can be a large solid cylinder that substantially fills the cam bore 23. The first 71 and second 72 rims can project from opposing ends of the cylinder. This, however, in some cases can add additional rotating mass to the cam 20.

As shown in FIGS. 2-4, the axle assembly 30 can include one or more cam spacers 80A and 80B. these cam spacers can be substantially identical so only the first cam spacer 80A will be described. The first cam spacer 80A can be disposed on the axle 40 between the limb portion 11 and the first bearing 50. The first cam spacer 80A can include a first spacer rim 81 that engages and is compressed against first exterior surface 51E of the inner portion 51 of the first bearing 50. This first cam spacer 80A can be in the form of a simple cylinder, or optionally as shown, it can include a first spacer rim 81 and a second spacer rim 82 on an opposing side of the cam spacer. Between the first cam spacer rim and second cam spacer rim, and annular cam spacer flange 83 can be disposed. This annular flange 83 can extend outwardly, away from the longitudinal axis LA of the axle which also corresponds to a longitudinal axis of or center of the cam spacer 80A. This annular flange can extend radially outward from the rims a distance D7. This distance D7 can be sufficient to conceal, hide and/or in some cases impair or prevent dust and dirt from engaging the bearing 50 adjacent which the spacer 80A is disposed. In some cases, the flange 83 can be annular, and can perfectly fit within the cam bore 23, thereby sealing the contents within the cam bore to some extent, when used with a second spacer 80 be on the opposite side the cam.

The flange 83 can be inset a distance from the first rim 81, which again can be positioned against the inner portion 51 of the bearing 50. In particular, this rim 81 per spacer rim 81 can be positioned against and forcibly engage the exterior surface 51E of the inner portion 51 of the bearing 50. The flange 83 can be offset a distance D8 from the outer portion 52 of the bearing so that it does not contact or press against it. The flanges also can extend to the interior 231 of the cam bore 23. When the axial clamping force ACF is applied to the axle assembly 30, that force can be transferred through the interior surface 11I of the limb 11, to the second rim 82 through to the first rim 81 of the cam spacer, directly to the inner portion 51 of the first bearing 50, to the first rim 71 of the compression spacer through the elongate body 70, to the second rim 72, to the inner portion 61 of the second bearing 60, to the rims of the second cam spacer 80B in to the limb 12. In other words, all these components can be generally under a compression force when the fasteners and/or the axle assembly in general are in a compression mode during which a compression force, such as the axial clamping force ACF is applied. This axial compression force, however with respect to the cam spacers, is not translated to compress the annular flange 83. The axial compression force also does not compress the flanges 77 and 78 of the compression spacer 70. Accordingly, these elements remain uncompressed and do not directly engage the cam or the outer portions of the first and second bearings. Therefore, the outer portions of the first and second bearings as well as the cam are free to rotate about the clamped inner portions of the respective bearings.

As mentioned above, the fasteners can be tightened direction T to put those fasteners and/or the axle assembly in a compression mode. In the compression mode, the compression force, for example the axial compression force ACF is exerted between the fasteners, in particular, between the heads of the fasteners that are drawn closer to one another. As a result of this axial clamping force, the axle caps 41C and 42C compress against the respective limb portions 11 and 12, which in turn compress under force against the cam spacers 80A and 80B. The rims of the spacers then compress against the adjacent inner portions of the first and second bearings. These inner portions are compressed toward the center line CL, but due to the compression spacer and its rims engaging the inner portions of these bearings, only the inner bearings portions are compressed. The exterior portions of the bearings are not compressed. These exterior portions are joined with the cam, and the cam is not compressed either. Thus, the bearing outer portions can rotate freely with the remainder of the cam.

A method of assembling the archery bow 10 will now be described with reference to FIGS. 2-4. In general, the method can include providing a first bearing 50 including an inner portion 51 and outer portion 52. The first bearing 50 outer portion 52 can be non-rotatably joined with the cam 20 having its respective one or more bowstring tracks. The first bearing, optionally with the cam attached, can be placed between the first limb portion 11 and the second limb portion 12. The axle 40 can be disposed through the first inner portion of the first bearing 50. A fastener and/or the axle assembly 30 can be converted to a compression mode to apply a compression force. For example, one or more of the fasteners can be tightened to apply the axial clamping force ACF to the first inner portion 51 of the first bearing 50 between the first limb portion 11 and the second limb portion 12. The first outer portion, 52, however remains uncompressed, unclamped, and not under the axial clamping force ACF when that axial clamping force is applied to the first inner portion. As a result, the first outer portion the cam 20 is free to rotate relative to the axle 40 and generally the axle assembly 30, while the first inner portion 51 remains non-rotating relative to the axle under the axial clamping force ACF.

More particularly, the cam 20 is provided. The first bearing 50 can be inserted into the cam bore 23 with its lip 52L engaging the shoulder 20S. The outer portion 52 can be friction fit against the cam bore 23. A compression spacer 70 can be spaced placed within the interior bore 23, optionally with the compression spacer flanges 77, 78 contacting its inner wall 231 or otherwise engaging the interior surface of the cam bore. On the opposite side of the cam, and the other end of the compression spacer, the second bearing 60 can be installed in the cam 20. The inner portion 61 can engage the second rim 72 of the compression spacer, while the first rim 71 engages the inner portion 51 of the first bearing 50. The flanges 77 and 78 however remain distal from the outer portions of the respective bearings so they do not touch those elements and or otherwise impair rotation of the outer portions. The second bearing 60 can be installed in the cam bore 23 so the outer portion 62 is friction or press fit into to the interior bore and the cam.

The axle 40 can be installed through the aperture 11A of the first limb portion 11. The first spacer 80A can be disposed over the second end 42 as the axle 40 is installed. The cam body 20 and can be inserted in the space 14 between the first limb portion 11 and a second limb portion 12, so that the holes or bores defined by the first and second bearings and the compression spacer align with the longitudinal axis LA of the axle 40. The axle can be slid through the first cam spacer 80A, through the inner portion 51 of the first bearing 50, through the bore of the elongated body 74 of the compression spacer 70, and through the inner portion 62 of the second bearing 60. Optionally, at this point, the second cam spacer 80B can be aligned with the axle 40. The axle can continue to be inserted toward the axle aperture 12A, thereby going through the second cam spacer 80 B. Insertion continues until the axle is installed through the second limb 12.

Optionally, where the axle caps are included in the construction, those elements can be installed such that the respective rings engage the exterior surfaces of the respective limb portions. The fasteners 40A and 40B can be threaded into the respective bores in the first end and the second end of the axle. These elements can be tightened in direction T so that the fastener and/or the axle assembly in general achieves a compression mode. In the compression mode, the components of the axle assembly as described above are compressed under the axial compression force described above. Generally, the inner portions of the bearings are compressed and clamped in a fixed orientation relative to the axle. All the gaps between the elements along the axle are effectively eliminated with the various components pressing against one another under a compression force. As mentioned above, the outer portions of the respective first and second bearings remain free to rotate, along with the cam to which they are joined. After assembly, the limbs, cam spacers, first and second bearings, compression spacer and axle caps have zero gaps between them along the axle.

Optionally, the various rims associated with the cam spacers 80A and 80B, and the compression spacer 70 can be replaced with precisely manufactured washers that are generally the same size and thickness as the rims so that those washers engage the inner portions of the respective bearings.

Figure 5:
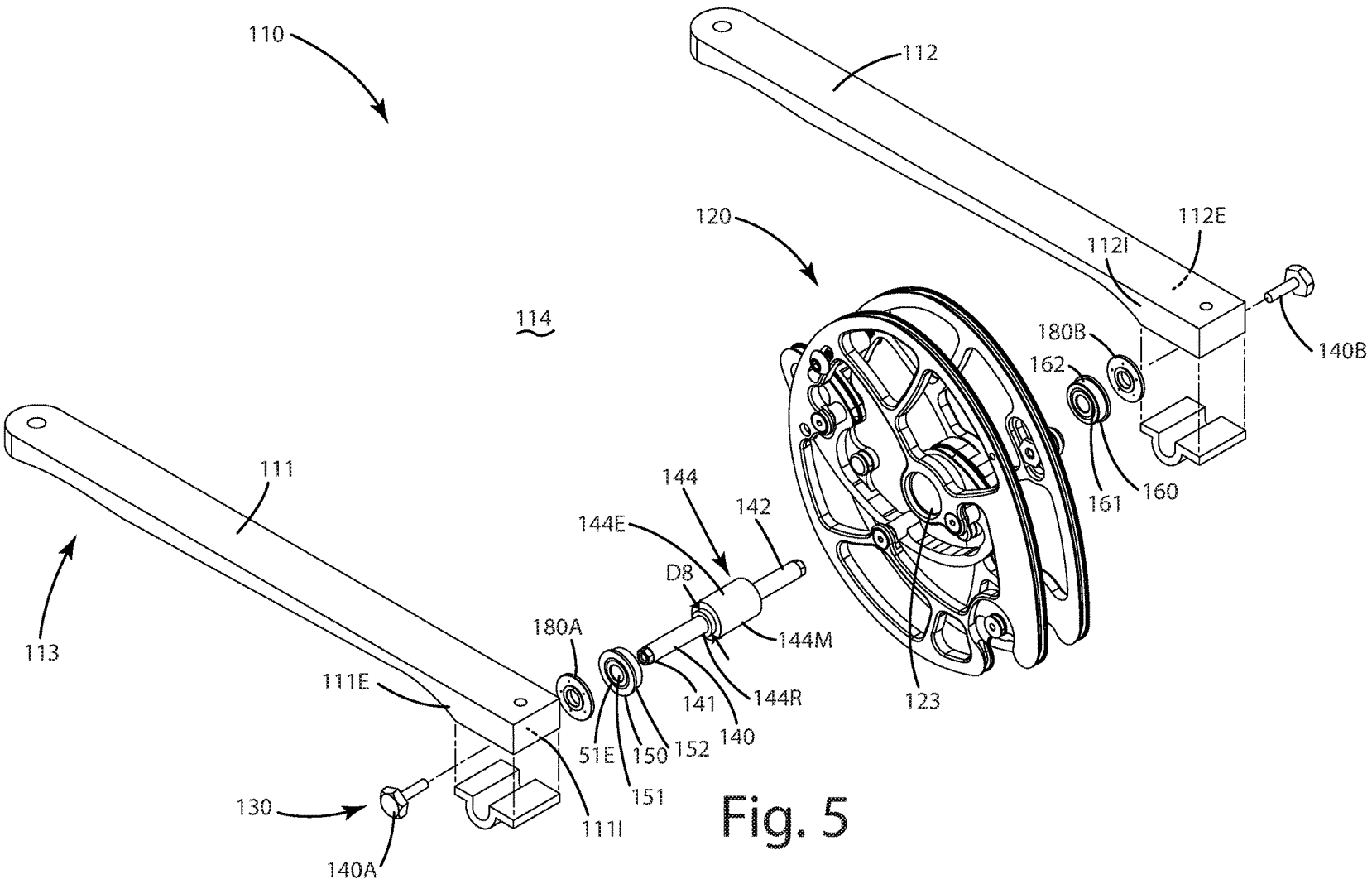
FIG. 5 is an exploded view of a limb, cam and axle assembly of an alternative embodiment.
Figure 6:
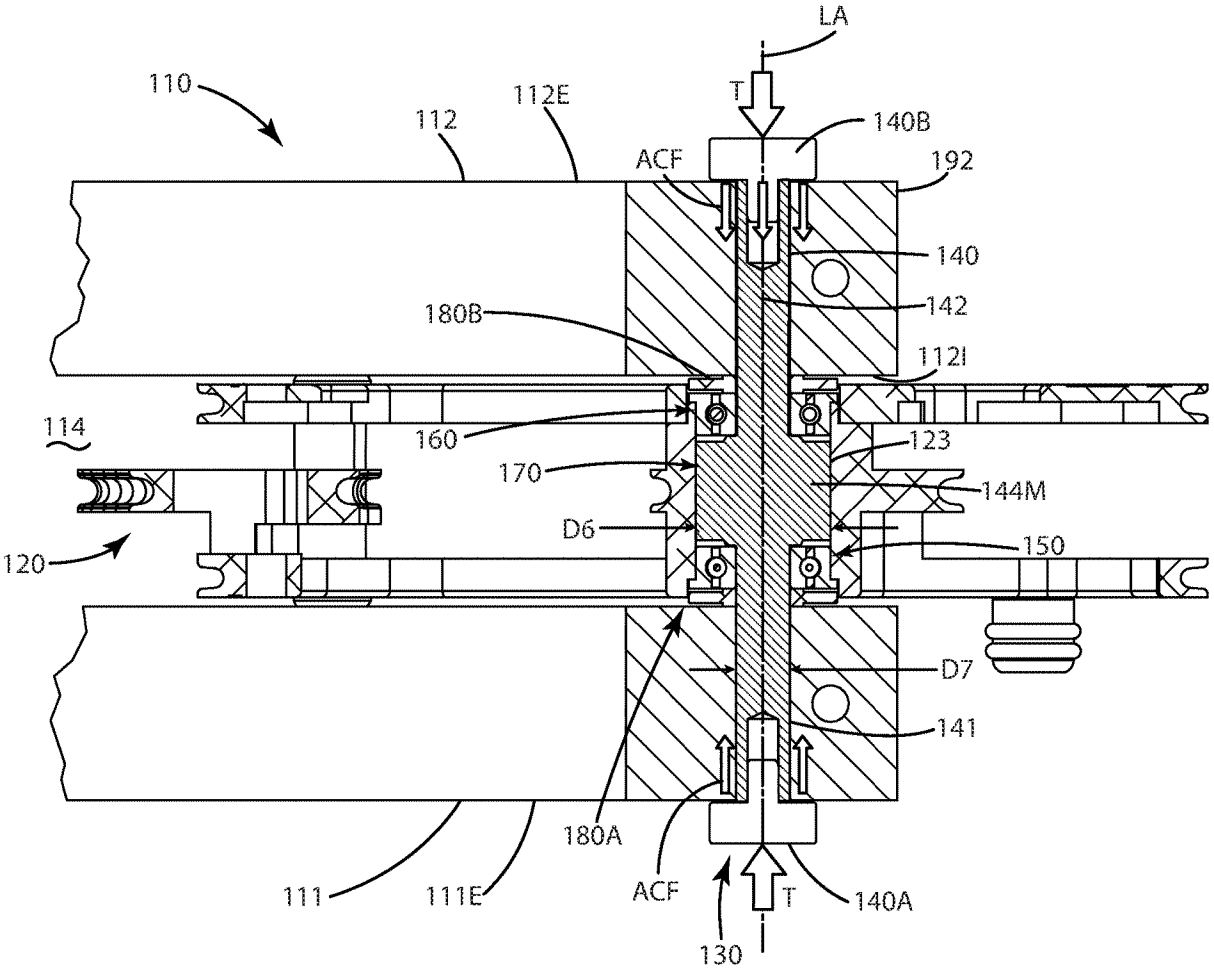
FIG. 6 is a section view of the limb, cam and axle assembly of the alternative embodiment.

An alternative embodiment of the archery bow 110 and the axle assembly 130 in general is illustrated in FIGS. 5-6. This embodiment is similar in structure, function and operation to the embodiment described above with several exceptions. For example, the bow 110 includes a limb 113 having limb portions 111 and 112. A cam 120 is disposed in the space 114 between the limb portions, and is rotatably mounted to those limbs with axle assembly 130. The axle assembly 130 can include the first bearing 150 and the second bearing 160 similar to the first and second bearings the embodiments above. It also can optionally include the fasteners 140A and 140B that thread into apertures defined by the axle 140. First and second cam spacers 180A and 180B also can be disposed between the limb interior surfaces 111I and 112I and the inner portions 151 and 161 of the respective bearings 150 and 161.

In this embodiment, the axle assembly 140 however, is mounted to the limbs via pillow blocks 191 and 192, which can be considered part of and can generally form the respective limb portions 111 and 112. These blocks can be mounted to the limb portions via fasteners, adhesives and/or other materials. The ends of the axle 140 can be mounted in portions of the blocks, and the fasteners 140A and 140B can engage those blocks to exert the axial compression force ACF through the limb portions to the inner portions of the bearings.

Further, in this embodiment, the compression spacer 70 of the embodiment above is replaced with central portion 144 of axle 140. This axle can be configured so that when installed it does not rotate relative to the limb, but the cam and outer bearings rotate relative to it. The axle 140 can include first and second ends 141 and 142. The central portion 144 can be located between those ends. The central portion can have a diameter D6 that fits inside the bore 123 of the cam 120, optionally without engaging the internal sidewall of that bore so that the sidewall can move relative to the outer surface 144E of the central portion of the axle. The ends of the shaft 141 and 142 can include a diameter D7 that is less than diameter D6 so the bearings, spacers and pillow blocks fit on those ends. The central portion optionally can be cylindrical in shape, but other geometric shapes also will work.

As shown in FIGS. 5 and 6, the central portion 144 also can include a shoulder or rim 144R. This rim 144R can be duplicated on opposite ends of the major portion 144M of the central portion toward the ends 141 and 142. This rim as shown can be annular, or disc shaped and can transition to the smaller diameter D7 of the axle shaft adjacent the central portion 144. This rim 144R can itself have a diameter D8 that is less than the diameter D6 of the major portion 144M of the central portion 144, but is greater than the diameter D7 of the remainder of the axle shaft. This rim 144R also can be sized and shaped so that the diameter is small enough that when the bearings 150 and 160 are installed and compressed against the central portion, only the inner portions of the bearings only contact the rims on opposite sides of the central portion. The outer portions of the bearings do not contact the rims nor the central portion. Indeed, spaces are disposed between the major portion and the outer portions of the bearings in the bore 123 when the axle assembly is under the axial compression force ACF after the fasteners are tightened.

Optionally, the axle 140 is a single, integral monolithic piece of material, with the various structures such as the central portion and the rim machined or molded into the axle. The axle can be constructed from metal, composites and/or polymers, and combinations thereof.

In this construction, when the fasteners 140A and 140B are tightened indirection T those fasteners effectively exert an axial clamping force ACF on the components between the ends of the axle 140. As result, the limb portions 111 and 112, for example the blocks 191 and 192, are compressed or pushed against the adjacent cam spacers 180A and 180B. The rims of the spacers (but not the annular flanges if included) are pushed against the inner portions 161 and 151 of the respective bearings. The bearing inner portions are compressed farther against the rims 144R of the central portion 144 of the axle such that the central portion of the axle is compressed along the longitudinal axis or parallel to it. With all of these components compressed, the inner portion of portions 151, 161 of the bearings 150, 160 are effectively under the compression force ACF and immovable relative to the axle 140. The outer portions of the bearings 152 and 162, however, along with the remainder of the cam 120, remain free to rotate.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. An archery bow comprising:

a limb;

an axle joined with the limb, the axle including a first axle end and a second axle end distal from one another;

a cam rotatably mounted on the axle, the cam including a bowstring track;

a first bearing comprising a first inner portion and a first outer portion, the first outer portion non-rotatably engaged with the cam; and a fastener joined with the axle and operable in a compression mode to thereby compress under a compression force the first inner portion of the first bearing between the first end and the second end of the axle, wherein the first outer portion remains uncompressed when the compression force is applied to the first inner portion so that the first outer portion and the cam are rotatable relative to the axle, while the first inner portion is non-rotatable relative to the axle under the compression force.

2. The archery bow of claim 1, wherein the limb includes a first sub limb and a second sub limb that are separated from one another along a respective length of each of the first sub limb and the second sub limb such that the limb is a split limb, wherein the first sub limb defines a first axle aperture and the second sub limb defines a second axle aperture, wherein the first axle end is adjacent the first axle aperture and the second axle end is adjacent the second axle aperture, wherein the axle extends through the first axle aperture and the second axle aperture, wherein the fastener threads to corresponding threads defined by the axle, wherein the fastener is rotatable such that when tightened, the fastener achieves the compression mode and the fastener clamps the first sub limb, the first inner portion of the bearing and the second sub limb between the first axle end and the second axle end.

3. The archery bow of claim 2 comprising:

a second bearing comprising a second inner portion and a second outer portion, the second outer portion non-rotatably engaged with the cam, wherein the second bearing is disposed a first distance from the first bearing along the axle, wherein the second inner portion of the second bearing between the first end and the second end of the axle is compressed under the compression force with the first inner portion when the fastener is tightened to the compression mode, wherein the second outer portion remains uncompressed when the compression force is applied to the second inner portion so that the second outer portion and the cam are rotatable relative to the axle, while the second inner portion is non-rotatable relative to the axle under the compression force.

4. The archery bow of claim 1, wherein the compression force is an axial clamp force of at least 1 pound, wherein the first inner portion cannot be rotated relative to the axle without applying at least 1 inch pounds of torque to the inner portion.

5. The archery bow of claim 1, wherein the compression force is an axial clamp force of between 1 pound and 500 pounds.

6. The archery bow of claim 1 comprising:

a second bearing comprising a second inner portion and a second outer portion, the second outer portion non-rotatably engaged with the cam distal from the first bearing, a compression spacer having an elongate body disposed adjacent the axle, the compression spacer located between the first bearing and the second bearing, the compression spacer including a first rim and a second rim distal from the first rim along the axle, the first rim pressed against the first inner portion and the second rim pressed against the second inner portion when the fastener is in the compression mode.

7. The archery bow of claim 6, wherein the elongate body is a cylindrical tube that circumferentiates the axle, wherein the elongate body includes a first annular flange inset a first distance from the first rim and a second annular flange inset a second distance from the second rim, wherein the first annular flange is offset the first distance away from the first outer portion of the first bearing, wherein the second annular flange is offset the second distance away from the second outer portion of the second bearing.

8. The archery bow of claim 7, wherein the cam defines a cam bore having an interior wall, wherein the compression spacer is disposed in the cam bore with the first annular flange and the second annular flange extending radially away from a longitudinal axis of the axle toward the interior wall.

9. The archery bow of claim 1 comprising:

a first cam spacer disposed on the axle between the limb and the first bearing, the first cam spacer including a first spacer rim pressed against a first exterior surface of the first inner portion of the first bearing, and a second spacer rim pressed against a first interior surface of the limb when the fastener is in the compression mode.

10. The archery bow of claim 9, wherein the first cam spacer includes a first spacer annular flange disposed between the first spacer rim and the second spacer rim, wherein the first spacer annular flange extends radially outward away from the axle so that the first spacer annular flange conceals the first outer portion of the first bearing but does not engage the first outer portion of the first bearing when the fastener is in the compression mode, wherein the first spacer rim and the second spacer rim project a preselected distance from first and second opposing sides of the first spacer annular flange.

11. The archery bow of claim 1, comprising:

An axle cap between the fastener and the limb, wherein the fastener is configured to engage the axle cap which engages the limb to deflect a first limb portion toward a second limb portion and the cam a predetermined distance.

12. The archery bow of claim 11, comprising:

a cam spacer between the limb and the first bearing, wherein the cam spacer forcibly engages an interior surface of the limb and the first inner portion, but not the first outer portion, when the fastener is in the compression mode, wherein the cam spacer is configured to be non rotatable relative to the first inner portion until a torque of at least 1 inch pound is applied to at least one of the cam spacer and the first inner portion.

13. An archery bow comprising:

a limb;

an axle joined with the limb, the axle including a first axle end and a second axle end distal from one another;

a cam rotatably mounted on the axle, the cam including a bowstring track;

a first bearing comprising a first inner portion and a first outer portion, the first outer portion non-rotatably engaged with the cam;

a second bearing comprising a second inner portion and a second outer portion, the second outer portion non-rotatably engaged with the cam distal from the first bearing;

a compression spacer located adjacent the axle between the first bearing and the second bearing, the compression spacer including a first rim and a second rim distal from the first rim along the axle, the first rim pressed against the first inner portion and the second rim pressed against the second inner portion, the compression spacer not engaging the first outer portion and the second outer portion;

a fastener joined with the axle and operable in a compression mode to thereby compress under a compression force the first inner portion against the first rim of the compression spacer and second inner portion against the second rim of the compression spacer, wherein the first outer portion and the second outer portion of the respective first bearing in the second bearing remain uncompressed when the compression force is applied to the first inner portion and the second inner portion so that the first outer portion, the second outer portion and the cam are rotatable relative to the axle, while the first inner portion and the second inner portion is non-rotatable relative to the axle under the compression force.

14. The archery bow of claim 13, wherein the compression spacer includes a first annular flange inset a first distance from the first rim and a second annular flange inset a second distance from the second rim, wherein the first annular flange is offset the first distance away from the first outer portion of the first bearing, wherein the second annular flange is offset the second distance away from the second outer portion of the second bearing.

15. The archery bow of claim 13, wherein the compression force is an axial clamp force of at least 1 pound, wherein the first inner portion, the second inner portion, the compression spacer, and the limb are clamped between the first axle end and the second axle end, wherein the compression spacer extends within an axial bore defined by the cam, between the first inner portion and the second inner portion.

16. The archery bow of claim 15 comprising:

an axle cap disposed between a head of the fastener and the axle, wherein the axle includes a first shoulder, wherein the axle cap includes a ring, wherein the ring bottoms out against the first shoulder when the axial clamp force is achieved by tightening the fastener relative to the axle.

17. The archery bow of claim 15 comprising:

a first cam spacer disposed on the axle between the limb and the first bearing, the first cam spacer including a first spacer rim pressed against a first exterior surface of the first inner portion of the first bearing, and a second spacer rim pressed against a first interior surface of the limb when the fastener is in the compression mode, and a second cam spacer disposed on the axle between the limb and the second bearing, the second cam spacer including a third spacer rim pressed against a second exterior surface of the second inner portion of the second bearing, and a fourth spacer rim pressed against a second interior surface of the limb when the fastener is in the compression mode, wherein the first spacer cam, the first inner portion, the compression spacer, the second inner portion and the limb are clamped between the first end and the second end of the axle when the fastener is in the compression mode.

18. A method of assembling an archery bow comprising:

providing a first bearing comprising a first inner portion and a first outer portion, the first outer portion non-rotatably joined with a cam having a bowstring track;

placing the first bearing between a first limb portion and a second limb portion;

installing an axle through the first inner portion of the first bearing;

clamping, with an axial clamping force of at least 1 pound, the first inner portion of the first bearing between the first limb portion and the second limb portion, wherein the first outer portion remains uncompressed when the axial clamping force is applied to the first inner portion so that the first outer portion and the cam are rotatable relative to the axle, while the first inner portion is non-rotatable relative to the axle under the axial clamping force.

19. The method of claim 18 comprising:

installing the axle through a second inner portion of a second bearing comprising a second inner portion and a second outer portion, the second outer portion non-rotatably engaged with the cam distal from the first bearing;

installing the axle through a compression spacer so that the compression spacer is located between the first bearing and the second bearing, within a cam bore defined by the cam, and so that the compression spacer does not engage the first outer portion and the second outer portion;

wherein the axial clamping force clamps the first inner portion against a first rim of the compression spacer and second inner portion against a second rim of the compression spacer.

20. The method of claim 18, comprising:

installing a first cam spacer adjacent the first inner portion, installing a second cam spacer adjacent the second inner portion, and clamping the first cam spacer against the first inner portion, against the compression spacer, against the second inner portion, against the second cam spacer, all between the first and second limb portions, so that none of the first cam spacer, first inner portion, compression spacer, second inner portion and second cam spacer are rotatable relative to one another unless at least 5 inch pounds of torque is applied to at least one of the first cam spacer, first inner portion, compression spacer, second inner portion and second cam spacer.

* * * * *